United States Patent [19]

Vogt

[11] Patent Number: 4,891,967

[45] Date of Patent: Jan. 9, 1990

[54] METHOD AND APPARATUS FOR DETERMINING THE AVERAGE FINENESS OF LOOSE FIBRES

[76] Inventor: Horst-Dieter Vogt, Hochstrasse 36, 8044 Zurich, Switzerland

[21] Appl. No.: 253,536

[22] Filed: Oct. 4, 1988

[30] Foreign Application Priority Data

Oct. 6, 1987 [CH] Switzerland ..... 3895/87

[51] Int. Cl.[4] ..... G01N 15/08

[52] U.S. Cl. ..... 73/38; 73/823

[58] Field of Search ..... 73/37.5, 38, 823, 825, 73/38

[56] References Cited

U.S. PATENT DOCUMENTS 2,706,904 4/1955 Hertel ..... 73/38
2,919,573 1/1960 Berkley et al. ..... 73/38
3,111,836 11/1963 Emmons, III ..... 73/38

FOREIGN PATENT DOCUMENTS 1553057 1/1969 France .
8703089 5/1987 World Int. Prop. O. .

*Primary Examiner*—Jerry W. Myracle

[57] ABSTRACT

Instead of a measuring chamber with a fixed volume, the present chamber is formed as a cylinder (12) with a piston (3) movable therein. The piston is pressed against the fibre sample (29) with constant compression force, and the respective volume of the measuring chamber is determined individually from the final position of the piston. Then an air stream is conducted through the fibre plug, the effect of the air stream together with the volume of the chamber allowing conclusions to be drawn regarding the fibre fineness. The displaceable piston ensures constant sealing of the fibre sample and makes precise metering of the fibre sample superfluous.

11 Claims, 4 Drawing Sheets

METHOD AND APPARATUS FOR DETERMINING THE AVERAGE FINENESS OF LOOSE FIBRES

Figure 1:
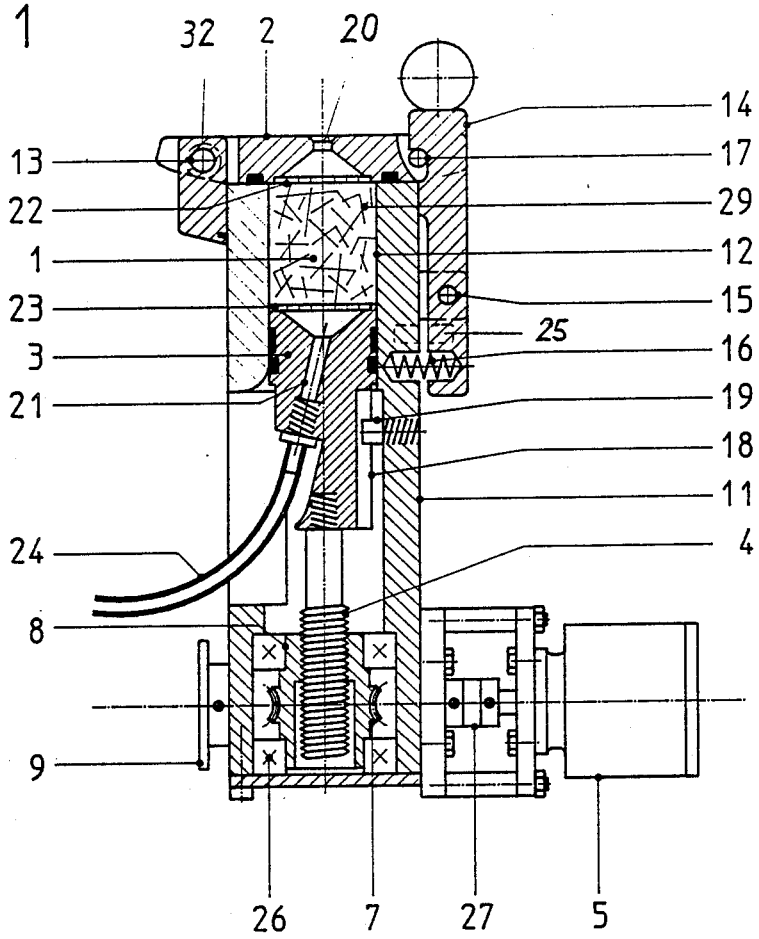

The invention relates to a method for determining the mean fineness of loose fibres, in particular of textile fibres, according to the preamble of claim 1. The invention also relates to apparatus for carrying out the said method according to the preamble of claim 4. The measuring method known and proven per se is based on the knowledge that the air resistance of a fibre sample in the measuring chamber is approximately proportional to the fineness of the individual fibres, i.e. to the ratio of volume to surface area of the fibres. Obviously, the volume of the fibre plug must be known for this calculation.

In the known apparatus, a measuring chamber with an unchangeable, known volume is filled with a predetermined mass of the fibres to be measured. The chamber is closed on both sides with a perforated cover in each case, one of which may be opened in order to insert the fibres. Air is blown or sucked through the fibre plug forming in the measuring chamber. The fall in pressure in the case of given air stream or the air stream in the case of a given fall in pressure then serves as a measurement of the fineness of the fibres.

A considerable disadvantage of the known method is that the fibre sample must be precisely weighed before measurement. Only in this manner can it be ensured that the total volume of the measuring chamber is in fact filled with fibres. Incomplete filling, i.e. a fibre plug with gaps in it, would lead to a distortion of the measuring result. The weighing method is time-consuming, however, and also presents a substantial potential source of error.

It is therefore an object of the invention to create a method of the kind cited at the beginning which can be carried out more simply and quickly and wherein all sources of errors can be as far as possible eliminated. Furthermore, the method is intended to permit, as far as possible, substantial automation of the measuring process. The associated apparatus should have a simple and compact structure and be easy to operate. This object is achieved by a method having the features of claim 1 and/or apparatus having the features of claim 4.

The method according to the invention has the advantage that the mass of the fibre sample may vary over a wide range without the measuring result being distorted. The weighing of the fibre sample before measurement can thus be omitted completely, which results in a considerable saving in time. This is particularly important in the case of mass measurements. The omission of the weighing of the fibre sample results in the elimination of a considerable potential source of error in determining the fineness of the fibres. Each individual fibre sample is compressed with constant force in such a manner that a compact fibre plug is formed in the measuring chamber. On completion of the compression process, the volume of this fibre plug is measured.

This measurement can be carried out particularly simply if the compression of the fibre sample is carried out by pushing a piston into a cylindrical chamber. The fibre plug is thus compressed evenly and the volume of the measuring chamber can be ascertained by various optical, electromechanical or electronic means. Moreover, the displaceable piston makes the filling and emptying of the measuring chamber easier. The piston can be moved into an extreme, rear final position for the insertion of the fibre sample, so that the fibres can be inserted easily and without laborious plugging into the extended measuring chamber.

The chamber is emptied particularly simply by pushing the fibre sample out of the cylindrical chamber with the piston after the measuring operation. This also saves difficult manual removal and clearing the chamber of residual fibres.

The apparatus can be actuated in a particularly simple manner if the piston is mounted non-rotatably in the measuring chamber and if the said piston is drivable with an electric motor via a threaded spindle. With the aid of a suitable electric motor, a constant power can be transmitted to the piston in a particularly simple manner. Furthermore, control operations such as, e.g. reversing for filling, compression and subsequent exhaust can be carried out particularly simply with an electric motor. If the threaded spindle is actuatable via a worm gear drive, the piston is blocked by self-locking in the end position and cannot be displaced by the counterpressure of the fibre plug. In addition, the electric motor can in this case be mounted laterally, which has further structural advantages.

A particularly advantageous construction of the drive is obtained if the threaded spindle is rigidly connected to the piston as a piston rod and engages in a nut formed on its exterior as a worm gear meshing with the worm. Obviously, it would be equally conceivable, however, to form the piston itself as a nut on its rear side and to connect the threaded spindle rigidly to the worm gear.

As an alternative to the electric motor, it would also be conceivable for the piston to be drivable hydraulically or pneumatically by means of a pressure medium cylinder, the said cylinder being capable of being acted on by constant pressure.

The apparatus is particularly advantageous as provided with measuring apparatus for automatically determining the final position of the piston proportional to a particular chamber volume. In the simplest case, this final position could be determined by a scale on the piston, the piston rod or the cylinder, for example. however, the reading of the scale again presents a source of error. In contrast, the measuring apparatus can feed its result directly into a computer, which evaluates the result direct together with the remaining measurement data.

The volume measurement of the measuring chamber can be carried out particularly advantageously if the measuring apparatus has a pulse emitter mounted on a part of the drive, e.g. a sector disk rotating with the drive shaft of the electric motor and engaging in a light barrier in order to count the revolutions completed. The light barrier registers each rotation or partial rotation of the sector disk and thus the piston stroke completed. From this, the respective volume of the measuring chamber can be derived directly. Obviously, other measuring apparatus would also be conceivable, such as e.g. potentiometers, incremental length measuring systems etc.

The opening of the cover and the pushing out of the fibre plug can be further simplified if the cover has a locking mechanism with a safety catch, which is adapted to be actuated electromagnetically, and if the cover is biased into an opening position by means of spring loading. The chamber cover can be automatically opened after the measuring operation by moving the piston gently back so that the chamber cover is released from the pressure of the fibre plug. At the same time, the locking mechanism is released by actuation of the electromagnets and the biased cover automatically snaps into the opening position. Then the piston is pushed up again and the fibre plug is pushed out.

An embodiment of the invention is illustrated in the drawing and described in more detail below.

Figure 2:
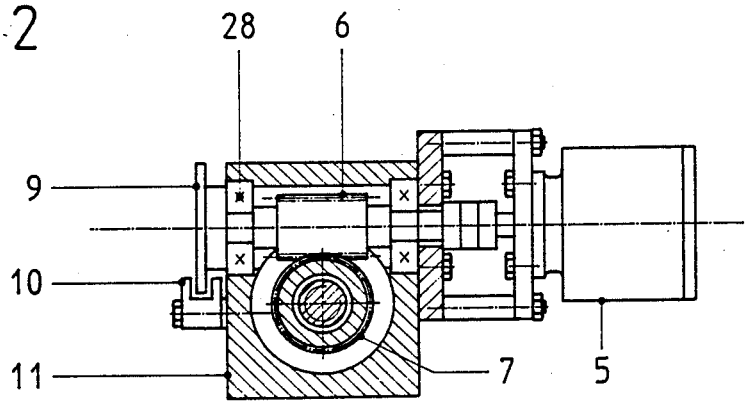
Figure 3:
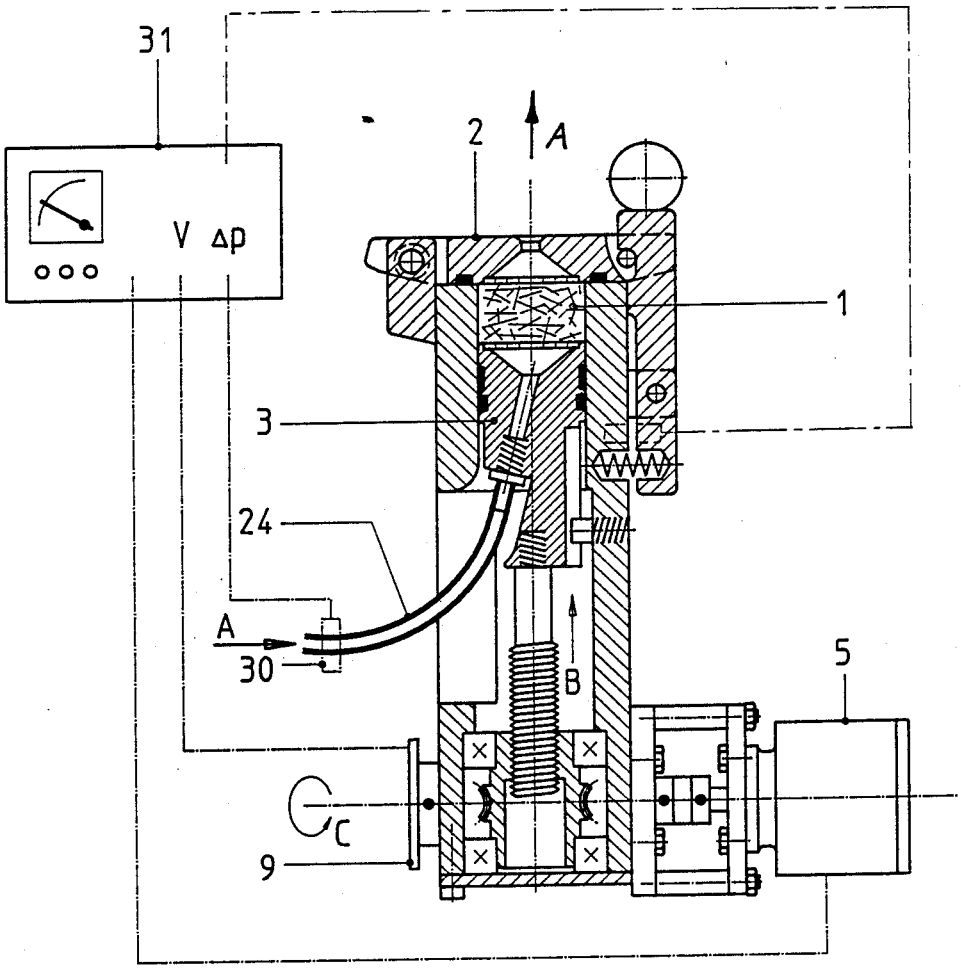
Figure 4:
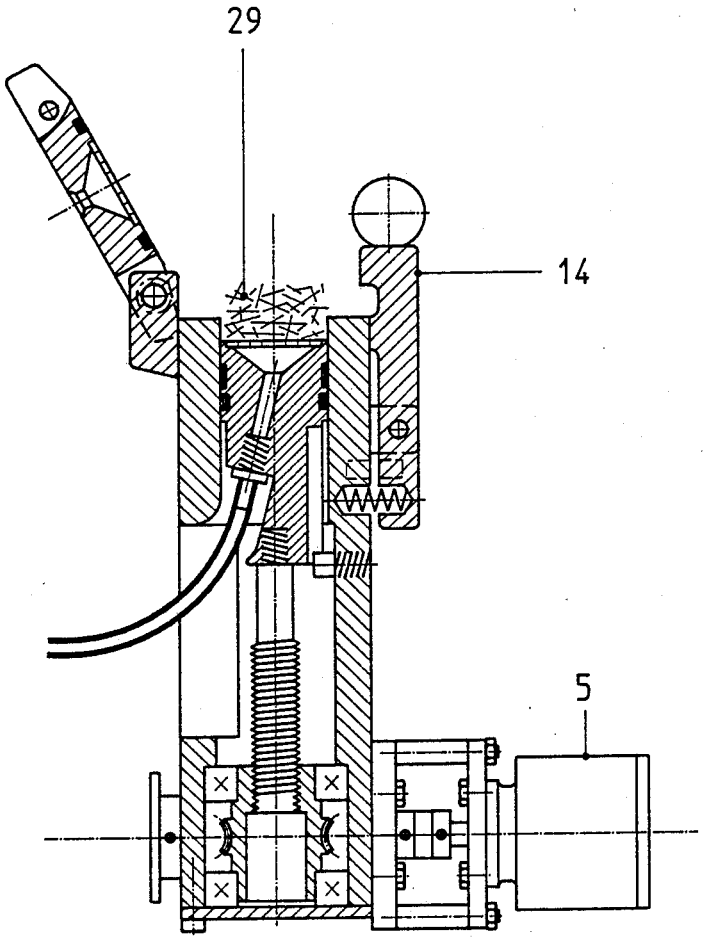
Figure 5:
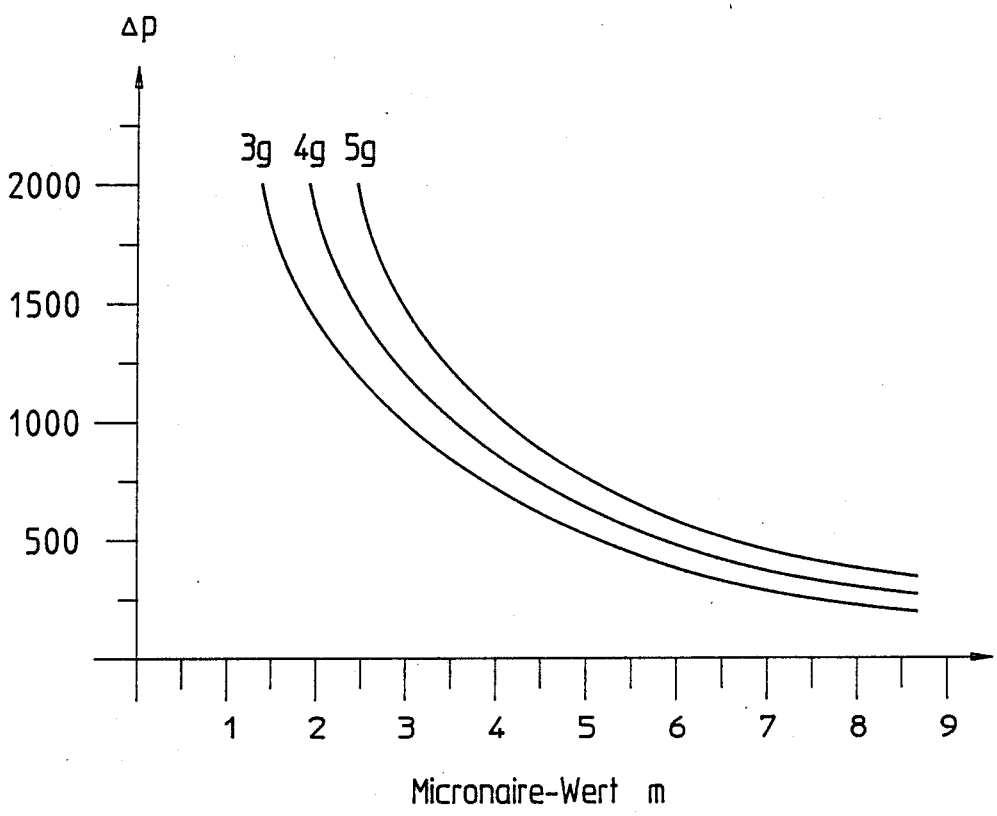

FIG. 1 shows a cross-section through apparatus according to the invention,

FIG. 2 a plan view, partly in section, of the apparatus according to FIG. 1,

FIG. 3 the apparatus according to FIG. 1 during the measuring operation,

FIG. 4 the apparatus with open cover while the fibre sample is being pushed out, and FIG. 5 is a diagram of the fibre fineness as a function of the pressure differential.

As can be seen from FIGS. 1 and 2, the apparatus essentially consists of a housing 11, whose upper part is formed as a cylinder 12. A piston 3 is displaceably mounted in this cylinder, the piston being provided with suitable piston seals so that the piston abuts the cylinder 12 in a sealing-tight manner in every position. The upper end of the cylinder is closed with a cover 2, which is pivotable about a hinge 13.

The cover 2 and the piston 3 form the two end faces of a measuring chamber 1 which receives the fibre sample 29 in the form of a plug. The piston 3 is provided with a piston bore 21, which widens conically towards the piston surface, for conducting through an air stream. The actual piston surface is formed by a piston filter 23. In a similar manner, the cover 2 is provided with a cover bore 20, which also widens conically. A cover filter 22 forms the end of this widening. Air can be blown through the measuring chamber 1 via the flexible conduit 24 and is discharged into the atmosphere via the bore 20.

The locking mechanism of the cover 2 has a safety catch 14 which is pivotable about a hinge 15. A pressure spring 16 is disposed below the hinge 15 and exerts a bias on the safety catch 14 in the direction of the the closing position. The safety catch locks over a shaft 17 on the cover 2 and thus holds the said cover in the closed position. The closing force of the pressure spring 16 can be overcome by the electromagnetic actuating device 25, which, when activated, moves the safety catch 14 into the opening position. A spring 32 rests on the shaft of the hinge 13 and biases the cover 2 in the opening direction. The cover thus opens automatically as soon as the safety catch 14 is released.

the piston 3 is provided with an axially parallel groove 18, which co-operates with a bolt 19 on the housing 11. In this manner the piston is mounted non-rotatably in the cylinder 12.

The piston 3 is provided with a threaded spindle 4 engaging in a nut 8, for actuating the said piston. The said nut is mounted in roller bearings 26 in the lower region of the housing 11 and has a worm gear 7 on its outer circumference. As can be seen from FIG. 2, the worm gear 7 meshes with a worm 6, which is also mounted in roller bearings 28 on the housing 11.

The worm gear 6 is connected to an electric motor 5, which is flanged on to the housing 11, via a suitable clutch 27. The said electric motor is preferably a direct current motor supplied with a known, constant current. In this manner, a constant advance power is exerted on the piston 3 via the worm gear drive. The driving electric motor 5 could also be a stepped motor. In order to limit the transmissible torque or to limit the advance power of the piston, the clutch 27 could also be formed as a friction clutch or a magnetic clutch.

For emitting pulses or measuring the completed piston stroke, starting from a given zero position, the worm 6 is connected to a sector disk 9 on the side facing away from the motor. The sector disk has translucent areas distributed evenly over its circumference and engages with a light barrier 10, which is secured to the housing 11. At each turn or partial turn of the sector disk, measuring pulses are thus generated in a known manner, and the respective piston position, and hence the respective volume of the measuring chamber 1, may be determined by the said pulses.

The dynamic pressure arising at the measuring chamber 1 is measured by means of an electronic sensor 30 connected to the conduit 24. Instead of the dynamic pressure, the pressure of the air could also be determined after it leaves the measuring chamber. The said sensor, and the light barrier 10, transmit their measuring pulses to a measuring and control device 31, such as illustrated in FIG. 3. The measuring and control device is also operationally connected to the electric motor 5 and optionally to the electromagnetic actuating device 25, so that a measuring operation can be carried out automatically by means of a control program. the fibre fineness is determined directly by a computer on the basis of the readings fed into the said computer, and is indicated in an analog or digital manner. Obviously, the measuring and control device can also be provided with a printer, so that measurement print-outs can be made.

In carrying out a measuring operation, the following method is used:

The piston 3 is in a retracted filling position, as is illustrated in FIG. 1 for example. The measuring chamber 1 is filled with a fibres sample 29 whose precise mass does not need to be taken into account. Then the cover 2 is closed, so that the safety catch 14 engages into the closing position. Thereupon, the electric motor 5 is actuated via the measuring and control device 31, so that the nut 8 is set in rotation via the worm gear drive. At the same time, the threaded spindle 4 is pressed upwards in the direction of the arrow B in such a manner that the piston 3 compresses the fibre sample 29 in the measuring chamber 1. The fibre sample 29 is compressed into a compact plug until a pre-determined compression force is reached. The electric motor stops and the piston 3 has reached its final position.

during displacement of the piston 3, the sector disk 9 also rotates in the direction of the arrow C and generates measuring pulses 10 at the light barrier 10. Each pulse in the positive or negative direction corresponds to a given volume of the measuring chamber 1. When the electric motor 5, and therewith the sector disk 9, stop, the measured chamber volume is automatically registered by the measuring and control device 31. Thereupon, an air stream is conducted through the measuring chamber via the conduit 24 in the direction of the arrow A, for example, and the sensor 30 measures the dynamic pressure. This reading is also fed to the measuring and control device 31, which now calculates the fibre fineness directly from the fall in pressure in the fibre plug and from the previously measured volume.

After the measuring operation proper, the piston 3 is retracted slightly by an appropriate control pulse to the electric motor 5, so that the pressure on the cover 2 is released. Then the safety catch 14 is released electromagnetically and the cover 2 springs into an open position. Then the piston can be raised completely, so that the fibre plug 29 is pushed out of the measuring chamber 1, as is illustrated in FIG. 4. Thereupon, the piston can be retracted back into its initial position in preparation for a new measuring operation.

FIG. 5 shows, by way of example, a diagram in which the measured fall in pressure delta p at the fibre plug is plotted on the ordinate in pascals. The three curves over the abscissa represent various fibre masses in the measuring chamber which were determined via the volume. From these values, the fibre fineness can be read, expressed in micronaire values on the abscissa.

I claim:

1. A method for determining the mean fineness of loose fibres, wherein a measuring chamber (1) is filled with a fibre sample (29) and then an air stream is conducted through the measuring chamber, and the effect of the fibres on the air stream is measured and from this measurement, the fineness of the fibres is calculated as a function of the volume of the measuring chamber, characterised in that, before the air stream is conducted through, the fibre sample (29) in the measuring chamber (1) is compressed by displacing at least one chamber wall with a constant force, and in that the chamber volume in the compressed state is measured separately for each fibre sample.

2. A method according to claim 1, characterised in that the compression of the fibre sample is effected by pushing a piston into a cylindrical chamber.

3. A method according to claim 2, characterized in that the fibre sample is pushed out of the cylindrical chamber by the piston (3) after the measuring operation.

4. Apparatus for determining the mean fineness of loose fibres having a measuring chamber (1) for receiving a fibre sample (29), the end faces of the said measuring chamber being perforated to permit the passing through of an air stream, one end face forming a lockable cover 92) for the measuring chamber 91), the improvement comprising a displaceable piston (3) forming the end face of the measuring chamber opposite the cover, means for pressing the piston against the fibre sample (29) with constant force, and measuring means for determining the final position of the piston proportional to a given volume of the chamber.

5. Apparatus according to claim 4, characterised in that the piston is non-rotatably mounted in the measuring chamber (1) and is drivable with an electric motor (5) via a threaded spindle (4), said motor and spindle comprising said means for pressing said piston against the fibre sample.

6. Apparatus according to claim 5, characterised in that the threaded spindle is actuatable via a worm gear drive (6, 7).

7. Apparatus according to claim 6, characterised in that the threaded spindle (4) is rigidly connected to the piston as a piston rod and engages in a nut (8), which is formed on its exterior as a worm gear (7) which meshes with the worm (6).

8. Apparatus according to claim 4, characterised in that the piston (3) is drivable by a pressure medium cylinder, which may be acted upon with constant pressure.

9. Apparatus according to claim 4, characterised in that the measuring device has a pulse emitter disposed on a part of the drive.

10. Apparatus according to claim 9, characterised in that the pulse emitter is a sector disk (9) rotating with the drive shaft of the electric motor (5), the said sector disk engaging in a light barrier (10) for counting the number of completed revolutions.

11. Apparatus according to claim 4, characterised in that the cover has a locking mechanism with a safety catch (14), which is actuatable electromagnetically and in that the cover is biased into an opening position by means of spring loading.

* * * * *